United States Patent [19]

Calvert et al.

[11] Patent Number: 4,541,130

[45] Date of Patent: Sep. 17, 1985

[54] BATHTUB ASSEMBLY

[75] Inventors: Scott A. Calvert, Granville; Robert J. Gelin; Dale Aberegg, both of Newark, all of Ohio

[73] Assignee: Owens-Corning Fiberglas Corporation, Toledo, Ohio

[21] Appl. No.: 598,660

[22] Filed: Apr. 10, 1984

[51] Int. Cl.[4] ..... A47K 3/12

[52] U.S. Cl. ..... 4/593; 4/595

[58] Field of Search ..... 4/538, 592, 593, 595

[56] References Cited

U.S. PATENT DOCUMENTS

| | | | |
|---|---|---|---|
| 1,282,255 | 10/1918 | McKinney | 4/538 |
| 2,122,247 | 6/1938 | Coordes | 4/595 |
| 2,305,846 | 12/1942 | Coordes | 4/593 |
| 2,841,795 | 7/1958 | Pelicano | 4/592 |
| 3,046,568 | 7/1962 | Holberson | 4/593 |
| 3,088,124 | 5/1963 | Long | 4/593 |

FOREIGN PATENT DOCUMENTS

| | | | |
|---|---|---|---|
| 326265 | 7/1970 | Sweden | 4/593 |

*Primary Examiner*—Henry K. Artis
*Assistant Examiner*—Linda J. Sholl
*Attorney, Agent, or Firm*—Ronald C. Hudgens; Greg Dziegielewski

[57] ABSTRACT

A tub assembly is provided wherein a bathtub assembly comprised of a bowl section having an apron extending downwardly therefrom and a pivotally mounted apron brace releasably secured to the bottom of the bowl in a first position to permit nestable stacking of one tub assembly within another for shipping and rigidly securable in a second position to provide lateral support to the apron.

6 Claims, 6 Drawing Figures

BATHTUB ASSEMBLY

TECHNICAL FIELD

The invention disclosed herein relates to bathtubs, and particularly, bathtubs molded from fiberglass reinforced plastic.

BACKGROUND

Bathtubs having an apron or skirt extending from the top of the tub down to the floor at the front of the tub generally require a lateral support system to prevent damage to the apron from inadvertent bumps or kicks to the apron. Historically, braces made from wood, metal or plastic have been screwed, glued and/or otherwise fastened either at the fabricating plant or at the installation site to rigidly reinforce the apron, generally, at the lower edge. Generally, one end of the brace is fastened at the distal end of the apron and the other end of the brace is fastened at the bottom of the tub bowl.

If the braces were installed at the tub manufacturing facility, such tubs were not generally able to be nested within one another to reduce the shipped volume of the articles. As such, shipping costs were unnecessarily high.

Others shipped the brace components as separate parts which were to be field installed. Such field installations can be very time consuming and, thus, labor intensive. Also, such separate parts can easily become irretrievably misplaced, requiring reprocurement of the brace resulting in construction schedule inefficiencies due to such disruptions.

The present invention provides a simple cost-effective bathtub assembly wherein the apron brace is pivotally attached to the tub body to permit the apron brace to be releasably secured at the plant in a first position for shipping in such a manner that the tub assemblies are readily nestable within one another. The apron brace arrives with the tub assembly and is easily snapped into position at installation in a matter of moments.

DISCLOSURE OF THE INVENTION

This invention pertains to a bathtub assembly comprising a bowl section having an apron extending downwardly therefrom and a pivotally mounted apron brace releasably secured to the bottom of the bowl in a first position to permit nestable stacking of one tub assembly within another and releasably securable in a second position to provide lateral support to the apron.

BEST MODE OF CARRYING OUT THE INVENTION

Figure 1:
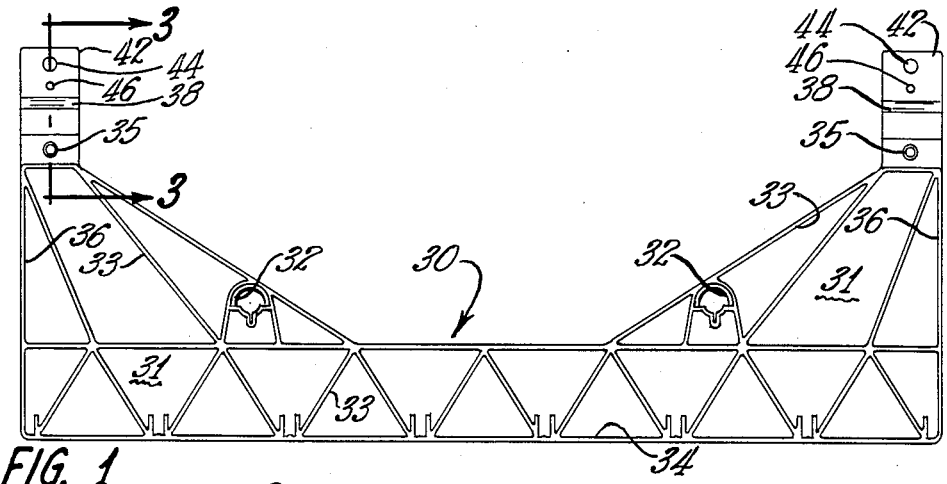
FIG. 1 is a plan view of an apron brace according to the principles of this invention.

According to the principles of this invention, a bathtub assembly 5 is comprised of a bathtub portion 10 and a brace portion 30.

Bathtub portion 10 is comprised of a bowl or receptacle body 12 having a shelf 11 extending around the upper periphery thereof. Of course, drain hole 13 is provided along the bottom of bowl 12. The bottom of bowl 12 incorporates a plurality of gussets 15 to stiffen the bottom wall of bowl 12.

As shown, a plurality of legs 17 project downwardly from the bottom of bowl 12 at the intersection of the gussets 15 to provide direct support to bowl 12 by means of legs 17 which are in contact with floor 95 when installed.

Also provided along the bottom of bowl 12, a pair of posts 19 project outwardly therefrom to permit base section 42 of brace 30 to be rigidly attached thereto by means of screw type fastener 89. Of course, base section 42 may be secured to post or projection 19 by any suitable means, such as an adhesive.

Extending downwardly from the shelf or landing 11 of bathtub portion 10, apron 22 is shown extending substantially to approximate engagement with floor 95. That is, the distal end of lip 24 of apron 22 extends downwardly from shelf 11 to a plane formed by the distal ends 18 of legs 17. Apron 22 terminates at a slightly protruded lip 24. Extended downwardly from apron 22, a plurality of pins 25 are spaced from lip 24 at the interior thereof to provide a plurality of notches or recesses 26 between pins 25 and lip 24 to receive foot 34 of brace 30 as will be explained in more detail later herein.

Bathtub portion 10 may be made from any suitable material such as fiberglass reinforced plastics, such as sheet molding compound or bulk molding compound, when such items are compression molded. Alternatively, such tub portions may be fabricated from fibrous glass and resin by the "hand layup" method.

Brace 30 is comprised of a planar section 31, a pair of base sections 42 having a hinge section 38 located intermediate planar section 31 at each base section 42. As shown, planar section 31 includes a plurality of ribs 33 interconnected over the major surface of the planar section 31 to provide torsional stiffness. Such ribs 33 are interconnected with foot 34 and upset lateral edges or beads 36 to provide an integral structure.

Apertures 32 in planar section 31 are provided to accommodate some of the legs 17 protruding from the bottom of bowl 12 as required when the brace 30 is in the "shipping" position.

Figure 2:
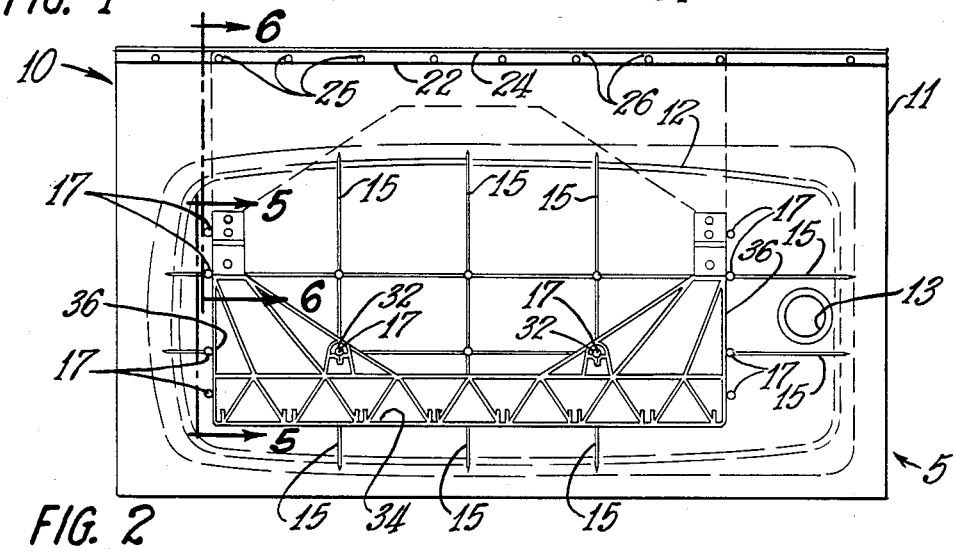
FIG. 2 is a plan view of the bottom of a bathtub assembly having the apron brace located in the shipping position; the apron brace is shown in phantom for the installed position.
Figure 3:
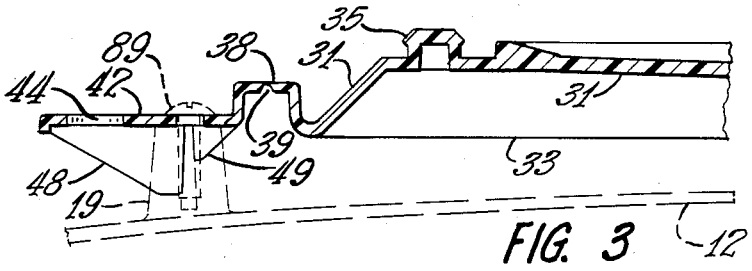
FIG. 3 is a cross-section of the apron brace shown in FIG. 1 taken along view 3—3.

Each hinge section 38 is provided with a laterally extending indentation 39 to provide a predetermined line along which hinge section 38 will bend or fold. Preferably, hinge section 38 is a "living hinge" although other hinge types may be acceptable. As such, planar section 31, hinge section 38 and base section 42 are injection molded from any suitable material, such as polypropylene, as a unitary or integral article. The flexibility and toughness of the polypropylene permits the brace 30 to be folded over at the hinge point at installation to the second or "installed" position as shown in FIGS. 2 (in phantom), 4 and 6.

Base section 42 of brace 30 is provided with an orifice 46 through which fastener 89 extends into post 19 to securely fasten base section 42 thereto.

Each base section 42 also includes a locating socket or hole 44 which is adapted to snugly receive stud 35 which extends from planar section 31 near hinge section 38. When in the closed or installed position, stud 35 is securely located in socket 44 to provide a positive mount for brace 30 at the bottom of body 12 such that the folded portion of hinge section 38 need not bear any substantial load. Since the folded material at hinge 38 has been severely stressed, repeated loadings from bumps and the like over the life of the system may cause the hinge to fail in the absence of some other positive connection as provided by studs 35 and locating socket 44.

Further, ribs 48 and 49 are provided on each base section 42 adjacent each other to form slot 50 therebetween. Slot 50 is adapted to securely receive a portion of a gusset 15 as found along the bottom of bowl 12 to provide additional positive load bearing location for brace 30 on bowl 12

Figure 5:
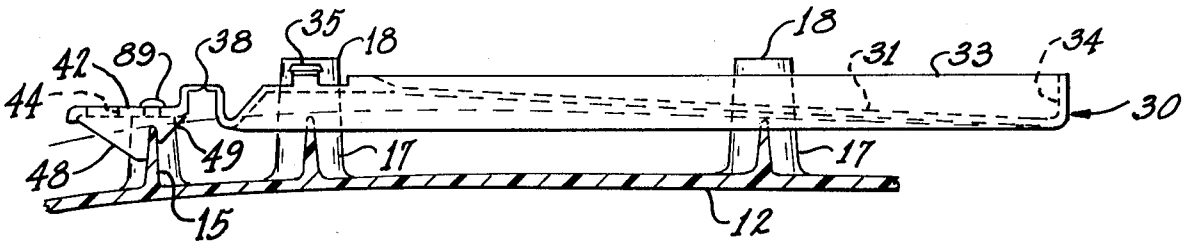
FIG. 5 is a side cross-sectional view of the tub assembly shown in FIG. 2 taken along view 5—5.

As shown in FIG. 5, when set in the "shipping" position, brace 30 is located within the zone formed between the distal ends 18 of legs 17 and the exterior surface of the bottom of bowl or body 12. Further, as shown in FIG. 2, planar section 31 of brace 30 is snugly located between legs 17 to provide a secure but releasable first or shipping position.

According to the principles of this invention, even with brace 30 so attached, the tub assemblies are readily nestable witin one another for shipping a plurality of such tub assemblies in a compact manner.

Figure 4:
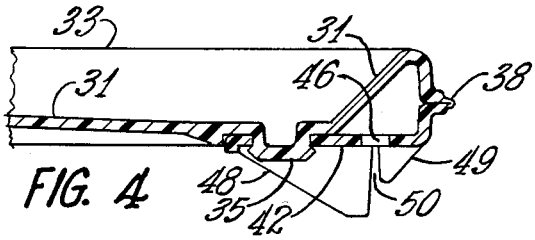
FIG. 4 is a side cross-sectional view of the apron brace shown in FIG. 1 showing the hinge in the installed or closed position.
Figure 6:
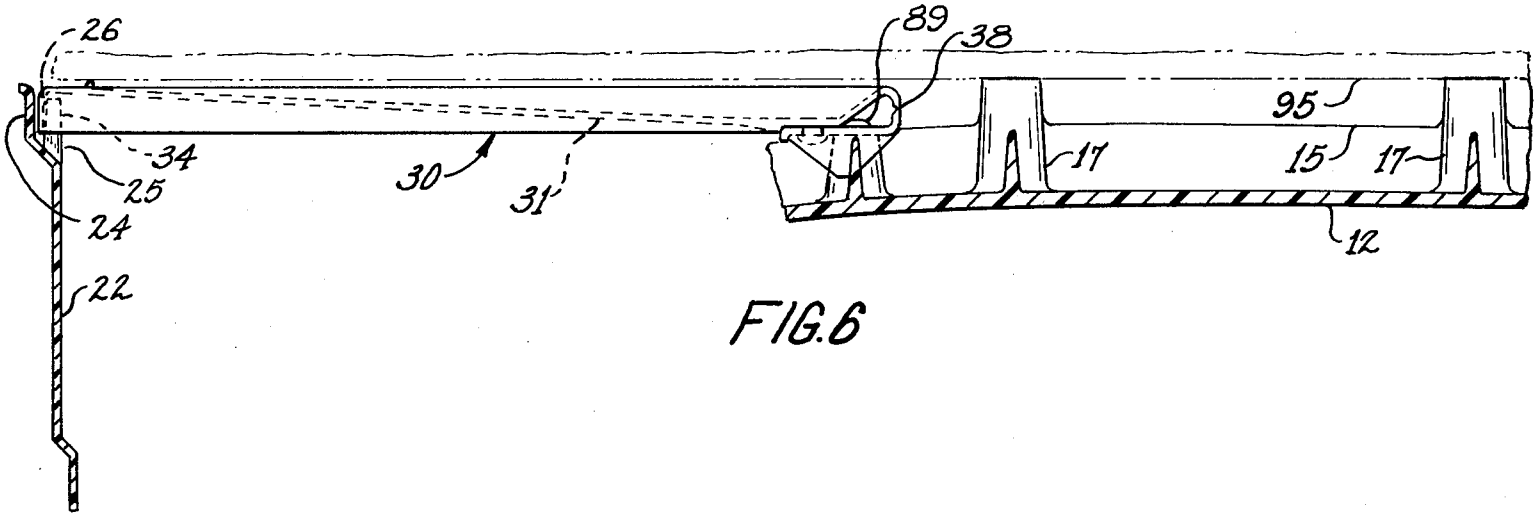
FIG. 6 is a side cross-sectional view of the tub assembly shown in FIG. 2 taken along view 6—6 wherein the apron brace is in the installed or support position.

When in the "installed" position as shown in FIGS. 4 and 6, stud 35 is securely, but releasably, located within socket or hole 44. Further, foot 34 extends from planar section 31 along distal edge thereof to provide "snap-in" attachment to the distal end of apron 22. As such, foot 34 is adapted to snugly wedge in recesses 26 formed between lip 24 and pins 25.

Thus, at installation, the workman merely pulls brace 30 at foot 34 to release the brace from between legs 17 and continues to fold the brace over along hinge sections 38 to meet the distal end of apron 22. At that point, foot 34 is snapped into position between lip 24 and pins 25, and studs 35 are snapped into locating sockets 44, all done quickly and easily by hand. As such, within a matter of moments, apron 22 is provided with secure lateral support.

It is apparent that within the scope of the invention modifications and different arrangements can be made other than as herein disclosed. The present disclosure is merely illustrative, the invention comprehending all variations thereof.

INDUSTRIAL APPLICABILITY

The invention described herein is readily applicable to the glass fiber reinforced plastic bathtub industry.

We claim:

1. A bathtub assembly comprising;

a receptacle body having a plurality of support legs and attachment posts extending therefrom, said body having an apron portion extending therefrom, said apron having a lip and plurality of pins forming a plurality of recesses therebetween adapted to receive an after defined foot;

a brace member having integral planar section, hinge sections and base sections, the hinge sections pivotally connecting the planar section and base sections, said planar section having a foot extending therefrom adapted to fit between said lip and pins of said apron, said planar section having a stud extending therefrom, said base sections having a locating socket adapted to receive said stud extending from said planar section when said brace is oriented in the installed position, said stud and socket being adapted to positively locate said brace along the bottom of said receptacle body; and fastening means adapted to attached said base sections to said posts.

2. The assembly of claim 1 wherein one tub assembly having said brace oriented in the shipping position is nestable within another such tube assembly.

3. The assembly of claim 1 wherein said base sections have a plurality of spaced apart rib sections adapted to interlock with gussets extending from and along said receptacle body.

4. The assembly of claim 3 wherein said planar section is adpated to be releasably positioned between the legs extending from said body.

5. The assembly of claim 4 wherein said body is made from a glass fiber-reinforced resinous material and wherein said brace is formed from a resinous material capable of functioning as a living hinge at said hinge section.

6. The assembly of claim 5 wherein said brace is made from polypropylene.

* * * * *